United States Patent [19]

Peters

[11] Patent Number: 4,707,942

[45] Date of Patent: Nov. 24, 1987

[54] INTERCHANGEABLE BARREL FOR COLT SELF-LOADING PISTOLS

[75] Inventor: Franz J. Peters, Paderborn, Fed. Rep. of Germany

[73] Assignee: Pool Patent- und Lizenzverwaltungs-GmbH, Berlin, Fed. Rep. of Germany

[21] Appl. No.: 632,631

[22] Filed: Jul. 19, 1984

[30] Foreign Application Priority Data

Jul. 22, 1983 [DE] Fed. Rep. of Germany ..... 3326521

[51] Int. Cl.[4] ..... F41C 21/00

[52] U.S. Cl. ..... 42/77; 89/29

[58] Field of Search ..... 42/77; 89/29

[56] References Cited

U.S. PATENT DOCUMENTS 2,898,693 8/1959 Ruger ..... 42/77

4,542,606 9/1985 Hoenig ..... 42/77 X 4,580,484 4/1986 Moore ..... 42/77 X

*Primary Examiner*—Peter A. Nelson

*Attorney, Agent, or Firm*—Mueller and Smith

[57] ABSTRACT

An interchangeable barrel for Colt self-loading pistols is mounted on a mounting rail, which is fixed to the frame and extends along the longitudinal orientation of the pistol. In the longitudinal middle region of the mounting rail, a longitudinally oriented recess of circular arcuate undercut cross-section enters into said mounting rail and receives a clamping member (48) which is connected to the underside of the barrel (12) and adapted to the cross-section of the recess. The clamping member (48) is detachably and vertically adjustably connected to the barrel (12) so that the barrel can be clamped to the mounting rail by means of the clamping member.

7 Claims, 19 Drawing Figures

INTERCHANGEABLE BARREL FOR COLT SELF-LOADING PISTOLS

The invention relates to an interchangeable barrel for Colt self-loading pistols, comprising a barrel mounting rail, fixed to the frame, and a longitudinally oriented recess of circular arcuate undercut cross-section entering into the rail and being adapted to receive a clamping member connected to the barrel at the rear bottom side thereof.

It is known to connect a barrel to a Colt self-loading pistol in this manner. In the known approach the clamping member is provided with a slot-like recess, extending transversely to the weapon and rising in the forward or rearward direction with respect to the horizontal, into which recess a pin is inserted, both of whose ends, emerging laterally from the clamping member, are situated in corresponding bores of the housing. By actuating an adjusting screw, extending in the longitudinal direction of the clamping member, one of the flanks of the slot-like recess can be thrust against the pin and the barrel can thus be fixedly clamped. However, since the pin is subsequently no longer rotatable, this approach is disadvantageous, if the pin belongs to the so-called catch which keeps the weapon open after the last shot. Moreover, the clamping force must be applied through a substantially linear contact along a surface line of the pin, so that some wear can occur in the course of time.

The problem to be solved by the invention is to construct an interchangeable barrel of the kind referred to so that a reliable and backlash-free clamping of the barrel is made possible without impairing the other functions of the self-loading pistol.

According to the invention this problem is solved in that the clamping member is detachably and vertically adjustably connected to the barrel.

By suitable adjustment of the clamping member against the barrel the clamping member can be clamped in the associated holding means and the barrel can be clamped against the mounting rail. With the adjusting facility it is possible to bridge a wide control range of manufacturing tolerances in the original weapon and the interchangeable barrel.

Vertical adjustment can be effected by means of expanding screws, by insertion of shim plates, by means of an adjusting cone or adjusting wedge, by means of an eccentric or in other manner. Details of the invention are so far disclosed in the subclaims.

Preferred embodiments of the invention will be explained hereinbelow by reference to the accompanying drawing.

Figure 1:
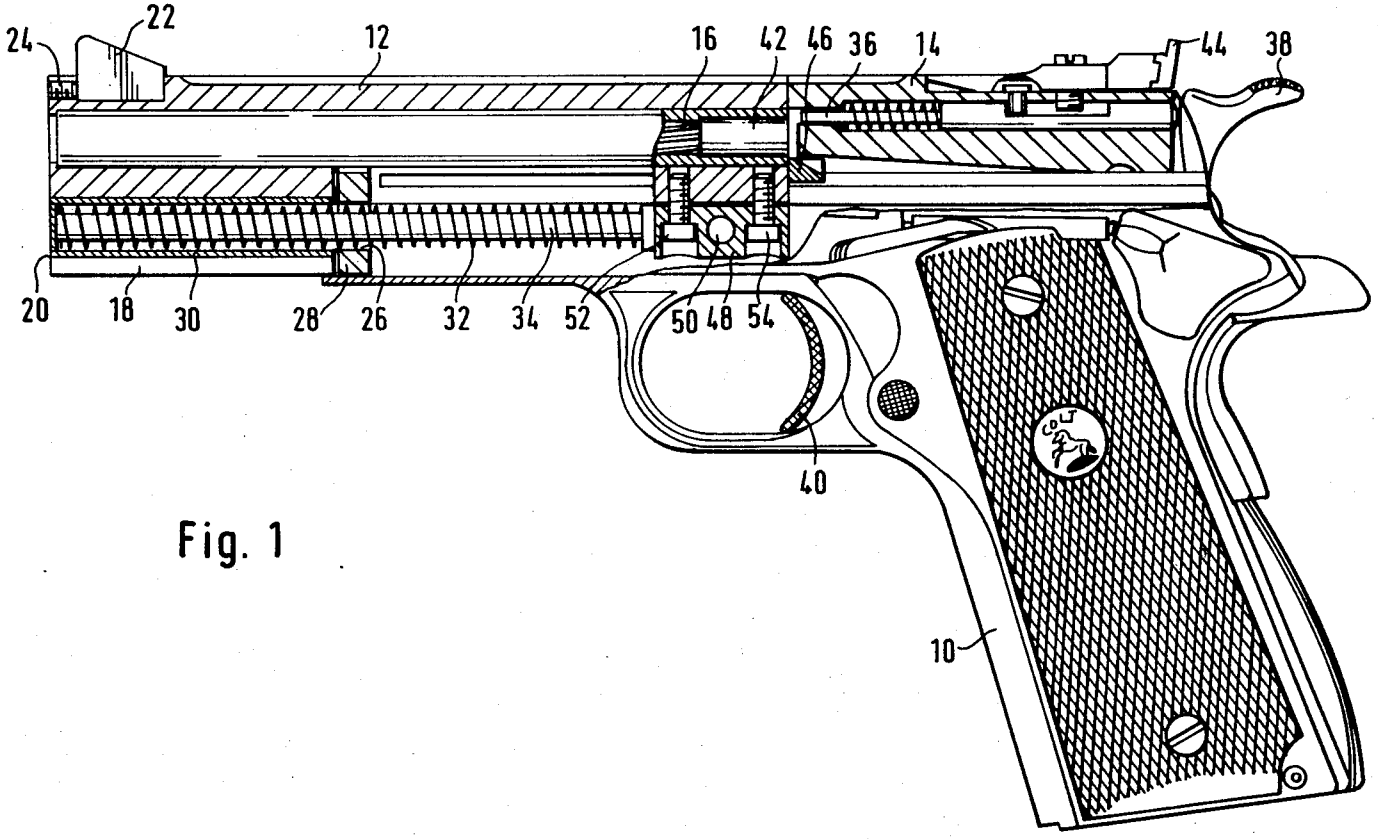
FIG. 1 is a partially sectioned side view of a Colt self-loading pistol with an interchangeable barrel according to the invention.

The Colt self-loading pistol shown in FIG. 1 is known and will therefore be described only briefly in general. It comprises a grip 10, a barrel 12 and a slide 14. The parts which are fixedly connected to the grip 10 will also be described as a frame in a different context. Indications of direction in the present description refer in each case to the upright position of the weapon in the hands of a marksman.

A barrel tube 16, which forms the proper barrel bore, is inserted into the barrel 12.

A downwardly projecting attachment 18, through which a bore 20 extends parallel with the barrel bore, is situated at the front end of the barrel 12.

A foresight 22, inserted into a pocket entering from above into the barrel in the illustrated example and being not referenced, is located at the top of the front end of the barrel. The foresight 22 is fixedly clamped in said pocket by means of a grub screw 24 which enters from the front face of the barrel. Therefore, the foresight 22 is interchangeable. This offers the advantage of permitting the insertion either of a foresight of rectangular configuration in side view, as preferred by sports marksmen, or a foresight which slopes downwardly to the rear, as illustrated in the drawing. This illustrated foresight offers the advantage of being less readily caught when withdrawn from a pocket.

In the region below the barrel the slide 14 is provided with an extension, not readily recognizable in FIG. 1, which terminates in a substantially annular, downwardly extending attachment 28 through which a bore 26 extends. Said extension is longitudinally slidably engaged with a slide guide, fixed to the frame and not referenced, so that the slide 14 can be moved forwards and backwards in relation to the frame or the grip 10.

A spring guide sleeve 30, which enters in the forward direction into the bore 20 and surrounds a recoil spring 32 and supports the same from its front end, is mounted on the attachment 28. The recoil spring, in the form of a helical compression spring, surrounds a spring guide rod 34, fixed to the frame. The recoil spring 32 pre-tensions the slide 14 in forward direction an returns it into the closed position after it was moved by the explosion pressure of a cartridge to the right in FIG. 1 while ejecting the spent cartridge case and inserting a new cartridge into the barrel from the magazine situated in the grip 10.

In the slide 14 a firing pin 36 is situated which, when the trigger 40 is operated, is struck by a hammer 38 against the rear edge of a cartridge 42. A rear sight 44 is mounted on the top of the slide 14. At the rear end of the barrel bore the barrel 12 is provided with a ramp 46 which serves to facilitate the transfer of a cartridge from the magazine disposed in the grip 10 into the rear end of the barrel bore during the loading process. In the illustrated example, this ramp 46 is not integrally joined to the barrel but screwed thereto, so that the barrel can be produced from a shorter piece of material and greater adaptability is provided for the form and arrangement of the ramp.

Details of the invention will now be explained. In FIG. 1, the rear end of the barrel 12 is provided on its underside with a clamping member 48, the purpose of which is to fixedly clamp the barrel 12 in relation to the frame. The clamping member 48 is provided with a bore 50 extending transversely to the weapon and serving to receive a catch in a manner not shown. The clamping member is connected to the barrel according to FIG. 1 by means of two screws 52, 54. Further details of the clamping member and its manner of connection to the barrel will be described by reference to the following Figures.

Figure 2:
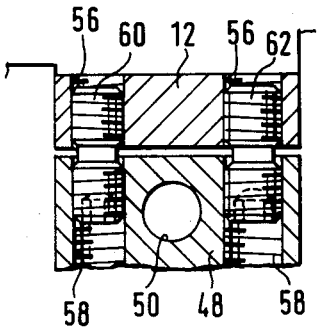
FIGS. 2 and 3 show a longitudinal section and an transverse section of one detail of a first embodiment of the interchangeable barrel.

FIG. 2 is a partial longitudinal and transverse section of the rear end of the barrel 12 and of the clamping member 48. In front of and behind the bore 50, the barrel and the clamping member are each provided with bores 56, 58, in alignment with each other, which are provided with internal screw threading of oppositely oriented pitch, so that, for example, the bores 56 of the barrel have left-hand screw threading and the bores 58 of the clamping member have corresponding right-hand screw-threading. Screw-threaded pins 60, 62, each having two portions, not referenced, of correspondingly oppositely oriented screw threading direction, are inserted into the bores which are in alignment with each other. Depending on the direction of rotoation of the screw threaded pins 60, 62, the barrel 12 and the clamping member 48 are therefore pulled together or spread apart.

Figure 3:
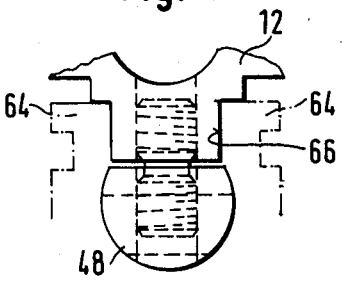

FIG. 3 shows in dash-dot lines a mounting rail 64 onto which the barrel can be slid. The mounting rail 64 comprises two separate webs with an opening 66 therebetween, extending along the longitudinal orientation of the weapon and expanding downwardly in circular arcuate configuration according to FIG. 3, so that the barrel 12 is secured against lifting off the mounting rail 64. The clamping member 48 is substantially adapted to the cross-sectional shape of the circular arcuate expansion of the opening 66, so that to clamp the barrel 12 and the clamping member 48 it is merely necessary to clamp these parts together or to spread them apart against each other. The screw-threaded pins 60, 62 are provided to this end.

The following Figures show other embodiments of this clamping mechanism so that the same reference numerals are used for corresponding parts and only the deviations will be separately explained.

Figure 4:
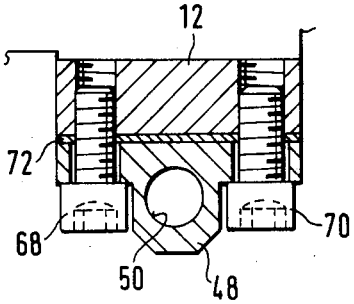
FIGS. 4 and 5 are corresponding views of a second embodiment.
Figure 5:
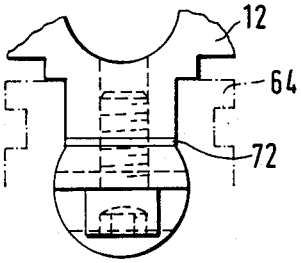

In FIGS. 4 and 5 the clamping member 48 and the barrel 12 are connected by means of conventional hexagon socket screws 68, 70 before and behind the bore 50. The relative position of the barrel and of the clamping member are defined by interchangeable spacer washers 72, which are inserted between the barrel and the clamping member.

Figure 6:
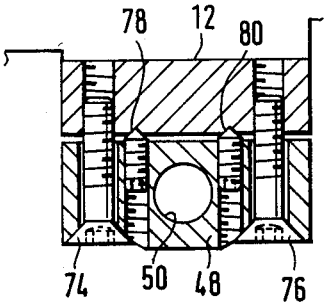
FIGS. 6 and 7 show a third embodiment of the invention in a corresponding view.
Figure 7:
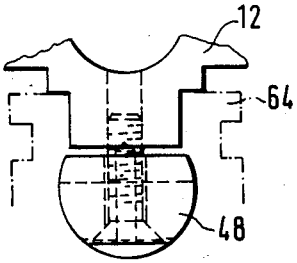

Two connecting screws 74, 76 are again provided in FIGS. 6 and 7 before and behind the bore 50 to connect the barrel 12 and the clamping member 48, and in the space between the connecting screws 74, 76 and the bore 50 there are provided in separate bores of the clamping member 48 screw-threaded pins 78, 80 which emerge in the direction of the barrel 12 and bear thereupon so that by operating the screw-threaded pins 78, 80 the barrel and the clamping member can be more or less spread apart.

Figure 8:
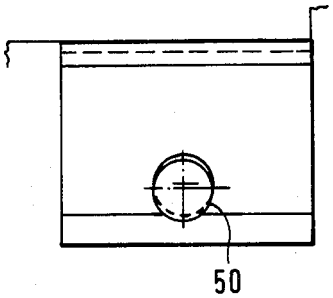
FIGS. 8 and 9 are similar views of a fourth embodiment.
Figure 9:
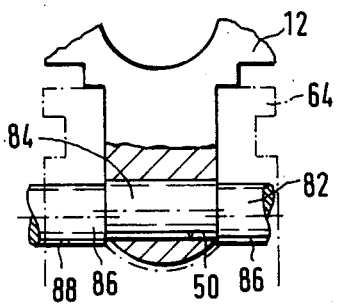

FIGS. 8 and 9 show an approach wherein a middle portion 84 of a double offset eccentric pin 82 is situated in the bore 50 of the clamping member and the offset external portions 86 are situated in bores 88 of the frame. The bores of the catch pin, not shown, are therefore utilized for adjusting the clamping member, so that this approach must be considered as less favourable, since the function of the catch pin requires free rotatability thereof.

Figure 10:
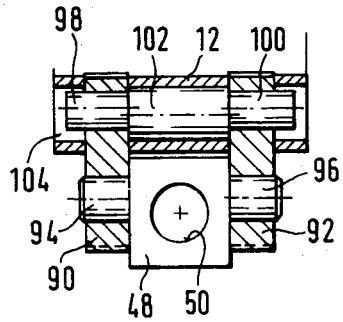
FIGS. 10 and 11 show a fifth embodiment of the invention.
Figure 11:
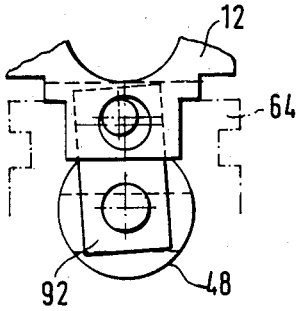

According to FIGS. 10 and 11, the barrel 12 and the clamping member 48 are connected by means of lugs 90, 92. Studs, which enter rotatably into bores, not referenced, of the lugs 90, 92 extend to the front and to the rear from the clamping member 48. Studs 98, 100 are situated in additional bores of the upper region of the lugs 90, 92 and extend in an eccentric position from a cylindrical central piece 102 which is situated in a longitudinally oriented bore 104 of the barrel 12. By rotating this eccentric, comprising the central piece 102 and the studs 98, 100, the clamping member 48 and the barrel 12 will be spread apart or drawn together.

Figure 12:
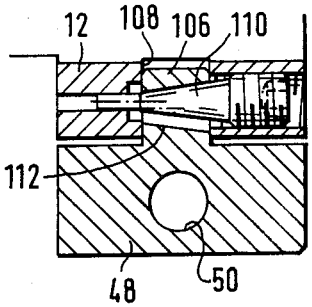
FIGS. 12 and 13 show a sixth embodiment of the invention.
Figure 13:
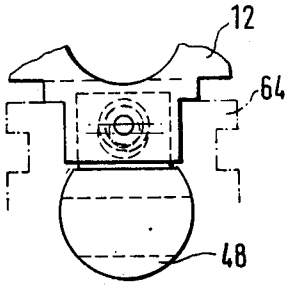

FIGS. 12 and 13, in which an upwardly oriented attachment 106, extending transversely to the weapon, enters into a corresponding recess 108 on the underside of the barrel, so that an adjusting screw, having a conical portion 110 within the recess 108, extends through the corresponding region of the barrel 12 over the recess 108. This conical portion 110 is situated within a conical bore 112 in the attachment 106 of the clamping member 48. The conical bore 112 has a larger diameter than the conical portion 110. It can be seen, that longitudinal adjustment of the adjusting screw with the conical portion 110 enables the clamping member 48 to be raised or lowered in relation to the barrel 12.

Figure 14:
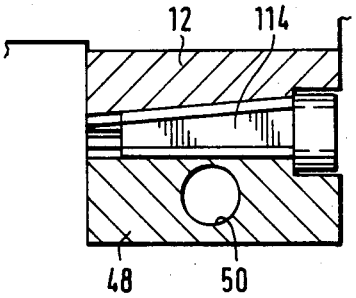
FIGS. 14 and 15 show a seventh embodiment of the invention.
Figure 15:
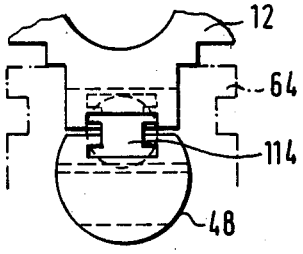

FIGS. 14 and 15 show an approach wherein the barrel 12 and the clamping member 48 can be spread apart by means of an adjusting wedge 114.

Figure 16:
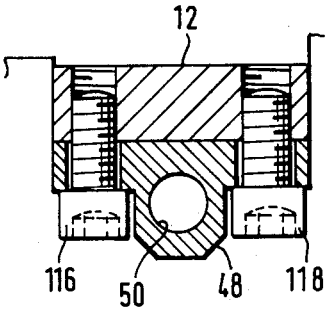
FIGS. 16 and 17 show an eighth embodiment of the invention.
Figure 17:
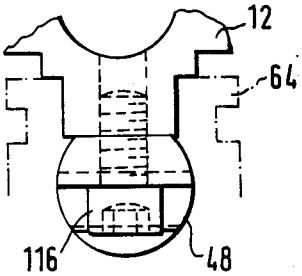

In FIGS. 16 and 17, the barrel 12 and the clamping member 48 are fixedly connected by means of connecting screws 116 and 118. The clamping member 48 consists of a relatively soft material and is produced with a certain oversize on the side facing the barrel 12, so that the clamping member surface facing the barrel 12 can be filed down in adaption to the tolerance conditions of each individual weapon.

Figure 18:
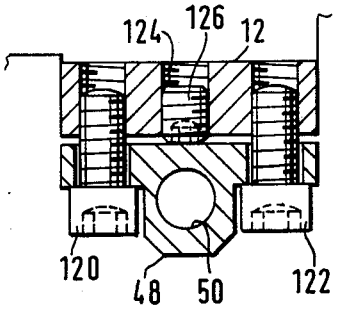
FIGS. 18 and 19 show a ninth embodiment of the invention.
Figure 19:
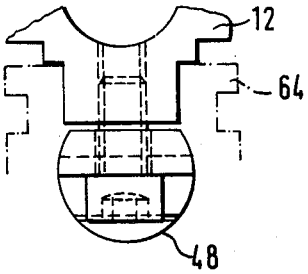

FIGS. 18 and 19 show an embodiment in which the barrel 12 and the clamping member 48 are held together by means of connecting screws 120, 122 in the manner already repeatedly described. A thrust screw 126 is situated in a middle screw-threaded bore 124 of the barrel 12 to permit a desired spreading to be adjusted between the barrel and the clamping member.

The preceding embodiments indicate numerous possibilities for connecting the barrel and the clamping member in vertical adjustable manner. The individual embodiments are therefore to be understood as examples only.

I claim:

1. Interchangeable barrel for Colt self-loading pistols, comprising a barrel mounting rail, fixed to the frame, and a longitudinally oriented recess of circular arcuate undercut cross-section entering into the rail and being adapted to receive a clamping member, connected to the barrel at the rear bottom side thereof, characterized in that the clamping member (48) is detachably and vertically adjustably connected to the barrel (12).

2. Interchangeable barrel according to claim 1, characterized in that the barrel (12) and the clamping member (48) are provided with bores (56, 58), which are in alignment with each other and have screw-threading pitches of opposite orientation, and that screw-threaded pins (60, 62) are screwed into the bores (56, 58), said screw-threaded pins having screw-threaded portions with oppositely oriented pitch within the barrel and the clamping member, respectively.

3. Interchangeable barrel according to claim 1, characterized in that the barrel (12) and the clamping member (48) are connected to each other by means of connecting screws (68, 70), and that interchangeable spacer washers (72) are inserted between the barrel and the clamping member.

4. Interchangeable barrel according to claim 1, characterized in that the barrel (12) and the clamping member (48) are provided with screw-thread bores in alignment with each other, into which connecting screws (74, 76) are screwed, and that separate screw-threaded pins (78, 80) are provided in the clamping member to bear against the surface of the barrel (12) facing the clamping member.

5. Interchangeable barrel according to claim 1, characterized in that the barrel (12) and the clamping member (48) are connected to each other through lugs (90, 92), and that the lugs (90, 92) are connected to the barrel and/or the clamping member by means of an eccentric (98, 100, 102).

6. Interchangeable barrel according to claim 1, characterized in that the barrel (12) and the clamping member (48) are each provided with an attachment (106), each adapted to enter into the respective other part, that said attachment (106) is provided with a conical bore (112), and that a longitudinally adjustable adjusting pin with a conical portion (110), extending through the conical bore (112), is supported in the respective other part.

7. Interchangeable barrel according to claim 1, characterized in that an adjusting wedge (114) is provided between the barrel (12) and the clamping member (48).

* * * * *